US005638248A

United States Patent [19]

Fawthrop

[11] Patent Number: 5,638,248

[45] **Date of Patent: *Jun. 10, 1997**

[54] STATIC DISSIPATOR

[76] Inventor: W. Gregg Fawthrop, 204B Cross Keys Rd., Berlin, N.J. 08009

[ * ] Notice: The term of this patent shall not extend beyond the expiration date of Pat. No. Des. 361,290.

[21] Appl. No.: 364,775

[22] Filed: Dec. 27, 1994

[51] Int. Cl.[6] ..... H05F 3/06

[52] U.S. Cl. ..... 361/221; 361/216; D10/105; 174/3

[58] Field of Search ..... 361/117, 118, 361/212, 216, 220, 221, 222, 217–219; 174/2, 3, 4 R, 6, 4 C; D10/105

[56] References Cited

U.S. PATENT DOCUMENTS

| | | | |
|---|---|---|---|
| D. 308,175 | 5/1990 | Sulyma | D10/105 |
| D. 339,306 | 9/1993 | Fawthrop | D10/105 |
| D. 361,289 | 8/1995 | Fawthorp | D10/105 |
| D. 361,290 | 8/1995 | Fawthorp | D10/105 |
| 1,757,172 | 5/1930 | Cazel et al. | 361/216 |
| 3,617,805 | 11/1971 | Truax | 361/221 |
| 3,628,090 | 12/1971 | McLain | 361/221 |
| 4,084,211 | 4/1978 | Okhotnikov et al. | 361/222 |
| 4,605,814 | 8/1986 | Gillem | 174/2 |
| 4,743,998 | 5/1988 | Wu | 361/42 |
| 4,910,636 | 3/1990 | Sadler et al. | 361/221 |

*Primary Examiner*—Fritz Fleming
*Attorney, Agent, or Firm*—Norman E. Lehrer

[57] ABSTRACT

A static dissipator for dispersing the electrical charge on a structure into the atmosphere in order to prevent lightning strikes comprises an electrically conductive core which includes a plurality of twisted cables. A plurality of wire filaments extends outwardly from the core. Each of the wire filaments has an end in the form of a fine dissipation point. A housing is secured around the wire filaments. The housing has a plurality of openings formed therein. A threaded connector extends from the bottom of the core for connecting the static dissipator to a fixed structure to be protected.

11 Claims, 1 Drawing Sheet

STATIC DISSIPATOR

BACKGROUND OF THE INVENTION

The present invention relates to a static dissipator for dispersing to the atmosphere the static buildup of electric charge on a structure in order to prevent lightning strikes. More particularly, this invention is directed toward a static dissipator having an electrically conductive core with wire filaments extending therefrom which terminate in fine dissipation points and with the core and wire filaments enclosed in a plastic housing.

Lightning is caused by electricity passing through the air. More specifically, the rapid movement of air causes varying concentrations of charges to be created on the water particles located in a cloud. As a general rule, the central portions of the cloud have positively charged ions while the lower portions of the cloud have negatively charged ions. The rain droplets that fall to the ground carry positive charges to the earth's surface. A lightning strike occurs when the negatively charged portion of the cloud seeks to neutralize itself with the positively charged earth.

It is known that lightning always seeks the path of least resistance on its descent to the earth's surface. Unfortunately, trees, houses, towers, watercrafts and other structures are usually the objects that provide lightning with an easier or least resistant path. Accordingly, lightning often strikes such objects thereby causing severe damage and destruction.

Lightning rods have been used for many years to reduce the damage caused by lightning. The conventional lightning rod is electrically grounded and is attached to the structure to be protected. Accordingly, the lightning is attracted to the rod and the charge is directed directly to ground thereby preventing structural damage. However, even if the structure is properly grounded, the lightning rod brings approximately 12,000 to 20,000 amps at 100,000 volts within a few feet from sensitive equipment such as phone lines, electrical service lines and cable TV lines. Surges created by the lightning can overload the circuits thereby damaging this sensitive equipment.

In order to alleviate the potential damage to electronic equipment, lightning dissipators have been developed that disperse electric charge on an object into the atmosphere so that the likelihood of lightning strikes is reduced. For example, U.S. Pat. No. 4,605,814 discloses a lightning deterrent device having a brush-like conductive structure that is particularly suited to be mounted on the top of a transmission tower. The device includes a cable formed in an annular configuration with a plurality of wires extending therefrom. The dissipator is adapted to be mounted around the periphery of a transmission tower and has a diameter that is sufficient to contain the vertical sides of the structure to be protected. Accordingly, if this device were to be used to protect a very large building, it would necessarily have a large diameter in order to contain the building's vertical sides. This can be rather impractical.

U.S. Pat. No. 4,910,636 discloses a static electricity dissipator having a plurality of conductive wires fitted through an opening in the upper portion of a tubular base member. The base member must be crimped in order to secure the wires thereto. The number of wires, and therefore the number of dissipation points, is limited by the diameter of the opening since the proximate ends of the wires are positioned therein. Accordingly, this dissipator does not sufficiently dissipate electric charge into the atmosphere.

Patent Nos. D 308,175 and D 339,306 describe more compact dissipators. However, they are not so aesthetically pleasing that one would want to utilize the same on a watercraft where it would be in plain view. Furthermore, because the wires are exposed in these prior devices, injuries could be sustained by persons who may contact the same.

SUMMARY OF THE INVENTION

The present invention is designed to overcome the deficiencies of the prior art discussed above. It is an object of the invention to provide a static dissipator that effectively and safely disperses to the atmosphere built-up electric charge on a structure.

It is a further object of the invention to provide such a static dissipator that can easily be mounted to a wide variety of fixed structures.

It is yet another object of the invention to provide a static dissipator that has an aesthetically pleasing appearance.

In accordance with the illustrative embodiments, demonstrating features and advantages of the present invention, there is provided, in one embodiment, a static dissipator having a conductive core. A plurality of wire filaments extend outwardly from the core. Each of the wire filaments has an end in the form of a fine dissipation point. A housing is secured around the wire filaments. The housing has a plurality of openings formed therein. A threaded connector extends from the bottom of the core for connecting the static dissipator to a fixed structure to be protected.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
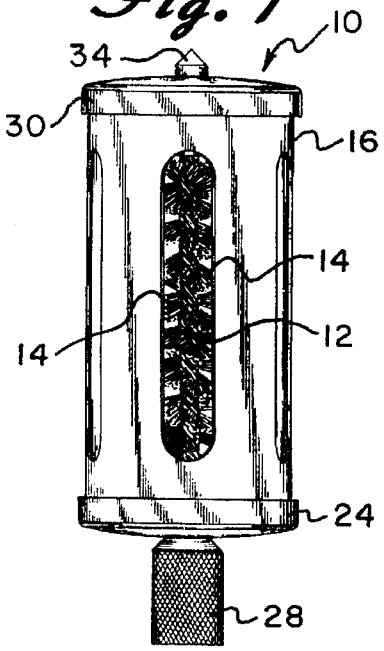
FIG. 1 is a front elevational view of a static dissipator constructed in accordance with the principles of the present invention.
Figure 2:
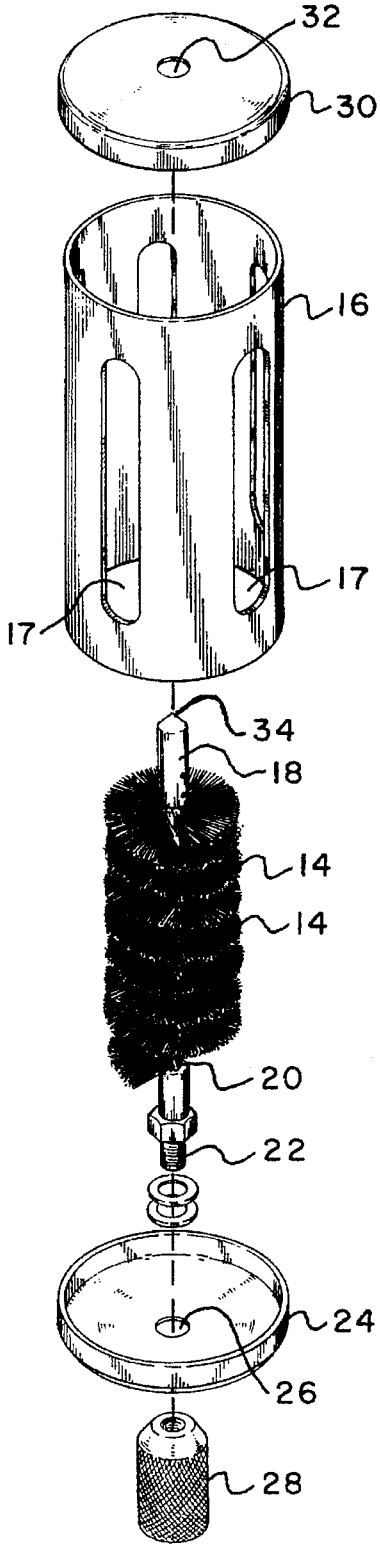
FIG. 2 is an exploded view of FIG. 1.

Referring now to the drawings in detail wherein like reference numerals have been used throughout the various figures to designate like elements, there is shown in FIGS. 1 and 2 a static dissipator constructed in accordance with the principles of the present invention and designated generally as 10.

The static dissipator 10 is comprised of an electrically conductive core 12, a plurality of wire filaments 14 extending therefrom, a threaded attachment 28 and a housing 16. The core 12 is preferably comprised of four twisted conducting cables made of a conductive material such as copper. However, any other electrically conductive material can be utilized. The core has an upper end 18 and a lower end 20 (see FIG. 2). In this embodiment, the core is approximately 7½ inches in length.

The wire filaments 14 extend between the windings of the conducting cables as illustrated in FIGS. 1 and 2. Each of the wire filaments 14 preferably has a diameter of 0.014 inches and terminates in a fine dissipation point. The filaments 14 are comprised of an electrically conductive material such as stainless steel or brass alloy. The wire filaments are electrically connected to the core 12 so that electric charge flows from the core 12 to the wire filaments 14 and then into the atmosphere. Accordingly, the amount of charge on the structure to be protected is sufficiently depleted and the chance of a lightning strike is diminished.

In the preferred embodiment, the lower end 20 of the core 12 has a threaded segment 22 extending downwardly therefrom. A bottom end cap 24 with an opening 26 formed through the center thereof is friction fitted around the bottom periphery of housing 16. The threaded segment 22 partially extends through the opening 26 in the cap 24. An attachment 28 with a knurled outer surface is secured to the threaded segment 22 below the bottom end cap 24. The attachment 28 can be threadably secured to the structure to be protected. It should be noted that the static dissipator 10 can be secured to the structure in a number of other ways such as by bolting or friction fitting the same to the structure.

The housing 16 is positioned over the core 12 and the wire filaments 14 as shown in FIG. 1. The housing is preferably comprised of a plastic such as polyvinyl chloride. As stated above, the bottom periphery of housing 16 is friction fitted in the bottom end cap 24. The housing has a number of elongated slots 17 formed therein to expose the dissipation points. The slots 17 also give the housing 16 an aesthetically pleasing appearance. It should be noted that the housing 16 also serves as a barrier between the dissipation points, which can be razor sharp, and persons in close proximity to the dissipator 10 in order to prevent injury.

In this embodiment, a point 34 is formed on the upper end 18 of the core 12. The point 34 extends upwardly from the core 12 above housing 16 as shown in FIG. 1. A top end cap 30, which has a hole 32 formed through the center thereof, is friction fitted around the top periphery of housing 16. When the cap 30 is so fitted, the point 34 extends through the hole 32 in the top end cap 30. The point 34 provides an additional dissipation point for the static dissipator 10.

The static dissipator 10 is preferably secured to an upper portion of the structure to be protected. The threaded attachment 28 allows the device to be easily attached to the structure. In use, the dissipator gathers the static buildup of electric charge on an object. The wind and circulation of air particles typically blow the accumulated ions into the atmosphere thereby neutralizing the charge on the structure. Accordingly, the charge on the structure never reaches a high enough value to be attractive to a lightning strike.

Figure 3:
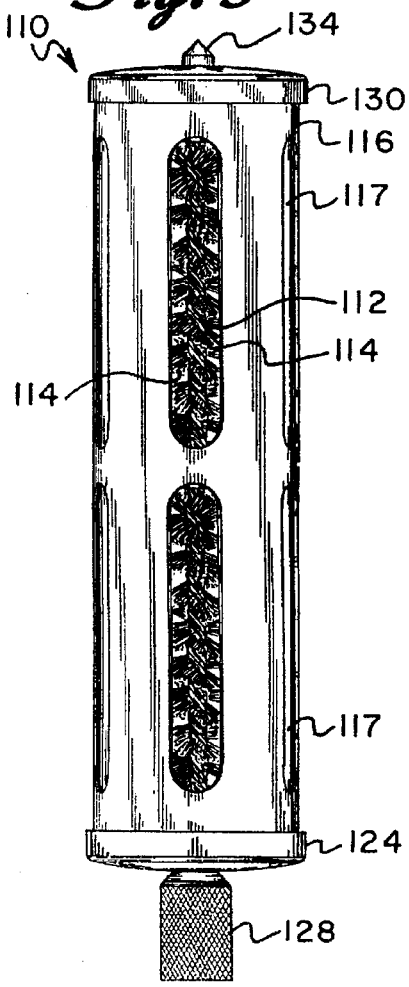
FIG. 3 is a front elevational view of an alternate embodiment.

Referring to FIG. 3, an alternate static dissipator 110 is shown. This embodiment is substantially the same as the embodiment shown in FIGS. 1 and 2. However, the length of core 112 is substantially greater than the length of core 12 shown in FIGS. 1 and 2. The preferred length of core 112 is 12 inches. Since the number of wire filaments 114 secured in the windings of the core 112 is increased, the number of corresponding dissipation points is similarly increased. Accordingly, higher levels of electrical charge can more rapidly be dissipated into the atmosphere.

The present invention may be embodied in other specific forms without departing from the spirit or essential attributes thereof accordingly reference should be made to the appended claims rather than to the foregoing specification as indicating the scope of the invention.

I claim:

1. A static dissipator for dispersing to the atmosphere static buildup of electric charge on a structure in order to prevent lightning strikes comprising:

an electrically conductive core having a top and a bottom;

a plurality of wire filaments extending outwardly from said core, each of said wire filaments having an end in the form of a fine dissipation point;

a housing secured around said wire filaments, said housing having a plurality of openings formed therein, and means extending downwardly from said bottom of said core for attaching said static dissipator to the upper portion of a fixed structure.

2. The static dissipator of claim 1 wherein said core includes a plurality of twisted cables.

3. The static dissipator of claim 2 further including a top cap, said cap having a hole formed through the center thereof, said top cap being friction fitted to the upper portion of said housing and said top of said core extending through said hole in said top cap.

4. The static dissipator of claim 2 wherein said wire filaments are comprised of stainless steel.

5. The static dissipator of claim 2 wherein said wire filaments are comprised of brass alloy.

6. The static dissipator of claim 1 wherein each of said ends on said wire filaments has a diameter of approximately 0.014 inches.

7. The static dissipator of claim 3 wherein the length of the core is approximately 7½ inches.

8. The static dissipator of claim 3 wherein the length of the core is approximately 12 inches.

9. The static dissipator of claim 1 wherein said means for attaching said static dissipator to a fixed structure includes a threaded connecter.

10. The static dissipator of claim 1 wherein said housing is cylindrical in shape.

11. The static dissipator of claim 1 wherein said housing is comprised of plastic.

* * * * *